US009681742B2

(12) United States Patent
Stokes

(10) Patent No.: US 9,681,742 B2
(45) Date of Patent: Jun. 20, 2017

(54) SMALL CONTAINER SCRUBBER

(71) Applicant: Mandarin Associates, Ltd., Kowloon (HK)

(72) Inventor: Lloyd J. Stokes, Bothell, WA (US)

(73) Assignee: MANDARIN ASSOCIATES LIMITED, Kowloon (HK)

( * ) Notice: Subject to any disclaimer, the term of this patent is extended or adjusted under 35 U.S.C. 154(b) by 0 days.

(21) Appl. No.: 14/851,382

(22) Filed: Sep. 11, 2015

(65) Prior Publication Data

US 2016/0073770 A1 Mar. 17, 2016

Related U.S. Application Data

(60) Provisional application No. 62/049,957, filed on Sep. 12, 2014.

(51) Int. Cl.

| | |
|---|---|
| ***B08B 9/04*** | (2006.01) |
| ***A46B 9/02*** | (2006.01) |
| ***B08B 9/087*** | (2006.01) |
| ***A47L 17/00*** | (2006.01) |
| ***B08B 9/08*** | (2006.01) |
| ***A46B 15/00*** | (2006.01) |

(52) U.S. Cl.
CPC ..... *A46B 9/026* (2013.01); *A46B 15/0097* (2013.01); *A47L 17/00* (2013.01); *B08B 9/087* (2013.01); *B08B 9/0817* (2013.01); *A46B 2200/3006* (2013.01)

(58) Field of Classification Search
CPC .... A46B 9/02; A46B 2200/3006; B08B 9/087
USPC ..... 134/6, 8; 15/104.09, 104.096, 179, 181
See application file for complete search history.

(56) References Cited

U.S. PATENT DOCUMENTS

| | | | | |
|---|---|---|---|---|
| 4,922,936 A * | 5/1990 | Buzzi | A61C 15/02 | 132/321 |
| 6,125,495 A * | 10/2000 | Berg | A46B 13/001 | 15/179 |
| 2009/0194136 A1 * | 8/2009 | Yamashiro, Jr. | B08B 1/00 | 134/8 |

* cited by examiner

*Primary Examiner* — Nadine Norton
*Assistant Examiner* — Maki Angadi
(74) *Attorney, Agent, or Firm* — Lowe Graham Jones PLLC

(57) ABSTRACT

A scrubber is formed with a plurality of bristles and can be inserted into a bottle or similar vessel for cleaning. Several such scrubbers can be inserted into a single bottle such that the bottle can be shaken to allow the scrubber balls to reach all of the surfaces on the interior of the bottle.

9 Claims, 5 Drawing Sheets

SMALL CONTAINER SCRUBBER

PRIORITY CLAIM

This application claims the benefit of prior U.S. provisional application Ser. No. 62/049,957, filed Sep. 12, 2014, the contents of which are incorporated by reference.

FIELD OF THE INVENTION

The embodiments of this disclosure are generally related to devices for scrubbing and cleaning small vessels and enclosures, and in particular to scrubbing devices that can be placed entirely within such enclosures.

BACKGROUND OF THE INVENTION

Within the prior art there are countless examples of bottles for carrying potable liquids. Such bottles include "sports" bottles, and they are commonly designed for a user to be able to drink directly from the bottle, or from a cap attached to the mouth of the bottle. Typically, the mouths of such bottles are no larger than about 4.5 cm in diameter, and may be smaller than 2.5 cm. It is common for individuals to own a number of different bottles of different shapes. In some cases, a user may have bottles for many different applications or purposes, while in other cases, it is simply because a user tends to accumulate a variety of bottles for the same purpose, over time.

In order to clean the inside of a bottle such as a sports bottle, most commonly a person will use a bottle brush or a dish cleaning brush, either of which may have a number of bristles formed on the end of a long handle. The inclusion of the handle, however, can impede the ability of the bristled end to reach into all of the nooks and crannies within a bottle, particularly where the handle is rigid and the bottle has internal curvatures or other features.

SUMMARY OF THE INVENTION

The present invention relates to a scrubber, preferably formed with a plurality of bristles, which can be inserted into a bottle or similar vessel for cleaning In accordance with preferred versions of the invention, several such scrubbers can be inserted into a single bottle such that the bottle can be shaken to allow the scrubber balls to reach all of the surfaces on the interior of the bottle.

In some examples of the invention, the various pluralities of scrubbers may include scrubbers of varying sizes.

Most preferably, the diameter of the scrubber is less than the diameter of the mouth of the bottle, to aid in easy insertion and removal of the scrubbers.

In some versions, a hook can be used to aid in removing the scrubbers from the bottle once cleaning is finished.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Some bottle shapes are very difficult to clean using conventional bottle brushes, and although specialized brushes are sometimes available to clean particular bottle shapes, a brush that is effective for cleaning one bottle shape is usually not effective for cleaning many other shapes. The inventor therefore proposes a scrubber device capable of mechanically scrubbing portions of bottles that are otherwise inaccessible or difficult to reach.

Figure 1:
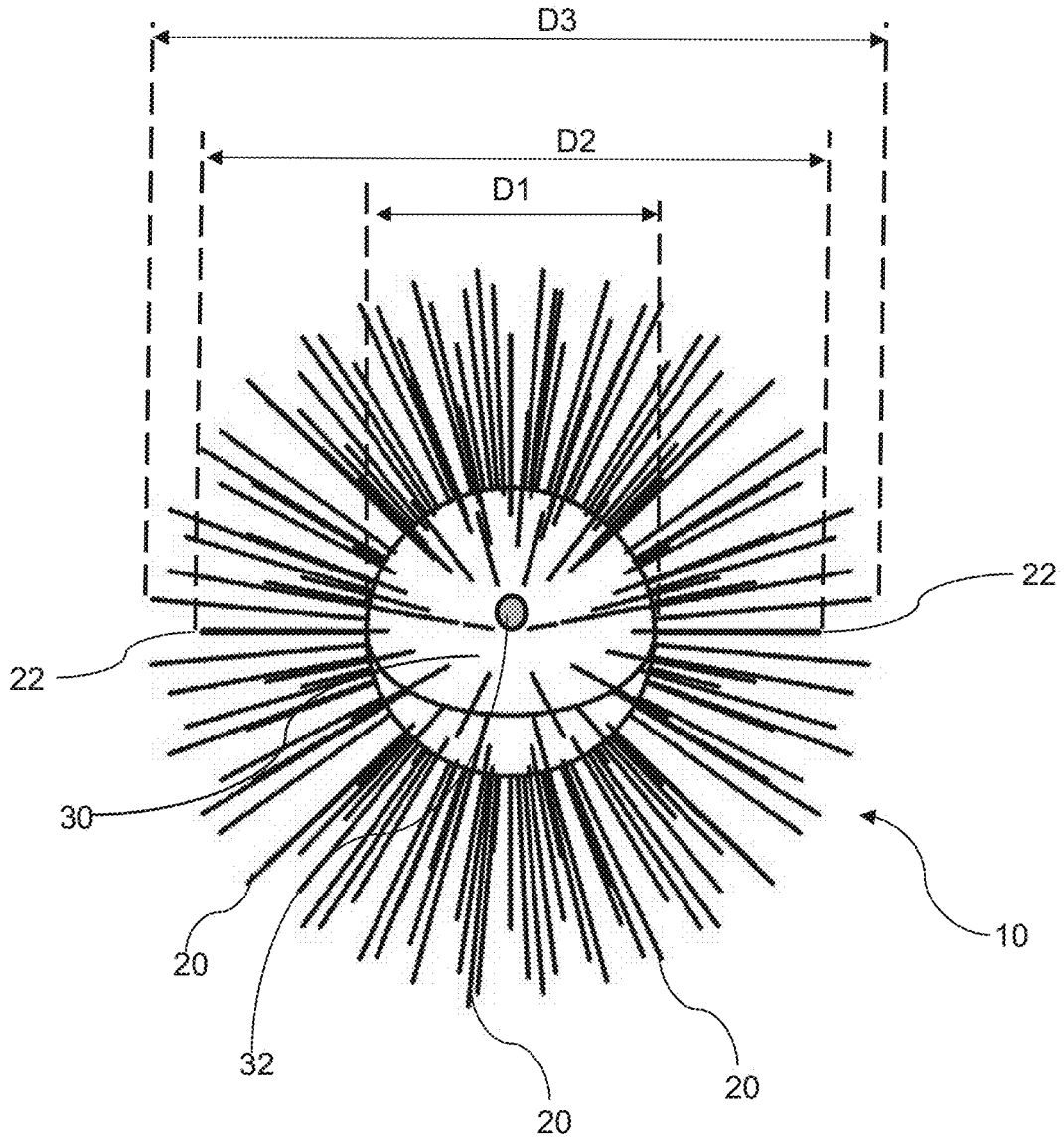
FIG. 1 is a top perspective view of a preferred scrubber.

FIG. 1 illustrates a preferred scrubber 10, according to an embodiment. The scrubber has a core 30 and a plurality of bristles 20, 22. In some versions, the bristles include a subset of longer bristles 20 and shorter bristles 22. The illustrated scrubber is generally spherical, and has a diameter that is sufficiently small as to fit through the opening of most common sport bottles. In the illustrated example, the scrubber 10 includes a core diameter D1 for the core 30, and a small bristle diameter D2 for the shorter bristles, and a large bristle diameter D3 for the longer bristles. The large bristle diameter D3 will therefore also be the largest diameter for the scrubber as a whole.

In one embodiment, a maximum dimension of the scrubber is less than about 5 cm for the diameter D3. According to another embodiment, a maximum dimension of the scrubber is less than about 2.5 cm. In a further preferred example, a scrubber is formed with long bristles forming a large bristle diameter D3 of 3.3 cm, and with small bristles having a small bristle diameter of 2.2 cm. Most preferably, the shorter bristles are relatively stiffer than the longer bristles.

The scrubber of FIG. 1 is illustrated as being generally spherical in shape and having a spherical core. However, this is not an essential feature. For example, the scrubber shown in FIG. 3 has a somewhat toroidal shape for its core structure 32. Thus, the term maximum dimension or diameter, as used with reference to a scrubber or some portion thereof, is not a maximum permissible dimension, but instead refers to a longest dimension of the referenced element that can be obtained by measuring between any two points on an outer surface of the scrubber. The term minimum dimension refers to a distance between parallel planes positioned on opposite sides of the device as close as possible to the device without touching, and oriented, with respect to the device, to produce the smallest value. Minimum diameter refers to the smallest diameter opening through which the referenced element can be passed without contacting the sides of the opening.

For example, inasmuch as the scrubber of FIG. 1 is approximately spherical, its minimum and maximum dimensions will be substantially equal. On the other hand, referring again to the scrubber of FIG. 3, its maximum dimension can be obtained by measuring through the center of the device along a horizontal axis lying parallel to the plane defined by the page, while its minimum dimension, assuming the pictured scrubber were an actual physical device, could be obtained by measuring between planes lying parallel to the plane defined by the page.

Figure 2:
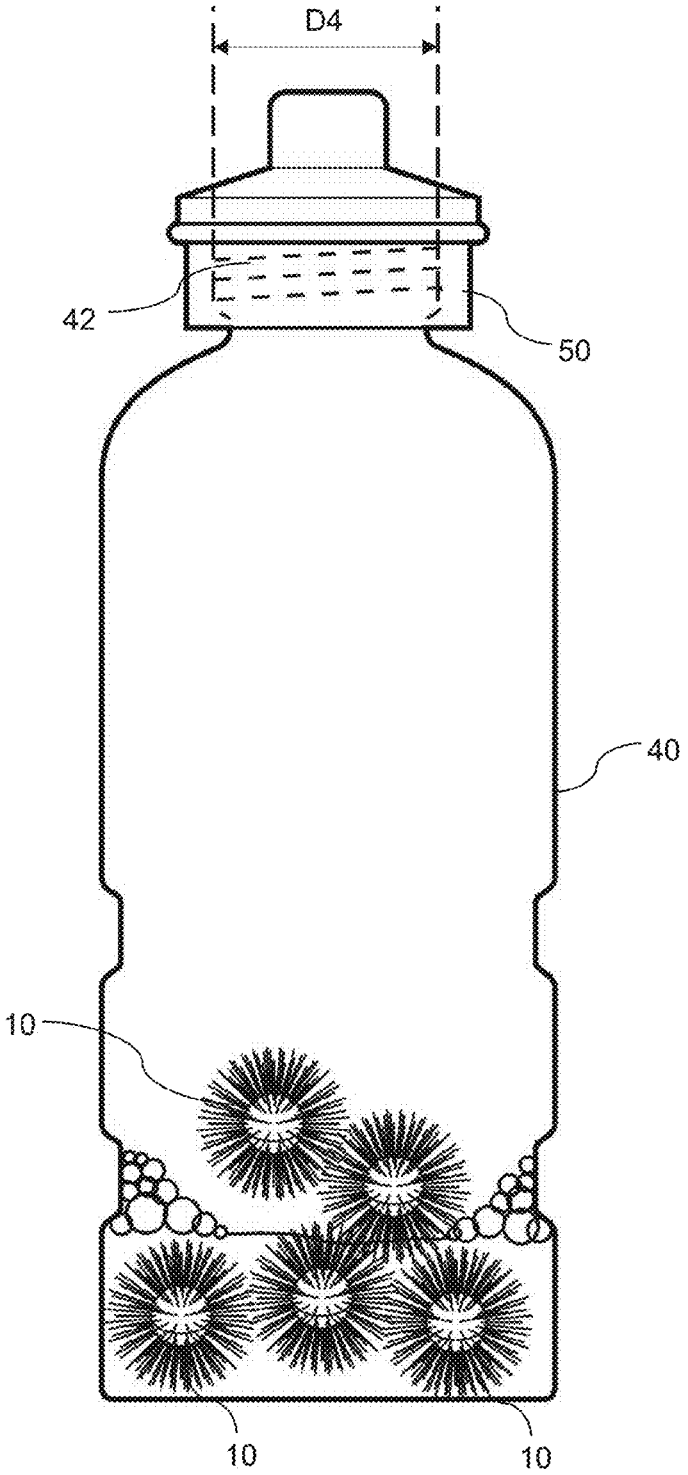
FIG. 2 is a front plan view of a representative bottle having a plurality of scrubbers inside, in accordance with a preferred method of using the scrubbers.

In operation, such as shown in FIG. 2, a user introduces one or a plurality of scrubbers 10 into a bottle 40 to be cleaned, together with a quantity of a liquid cleaning solution such as, e.g., a combination of water and detergent, etc., and then seals the bottle by securing the cap 50. The illustrated bottle includes a mouth 42 (shown in phantom lines, through the lid or cap 50). The mouth 42 forms an opening having a bottle opening diameter D4. As described above, the bottle opening diameter D4 should be greater than the core diameter D1. Most preferably the bottle opening diameter D4 is also greater than either of the large or small bristle diameters D2, D3, but in some versions of the use of the invention the bottle opening diameter D4 may be larger than the core diameter D1 but smaller than one or both of the bristle diameters D2, D3.

In some versions of the invention, each of the scrubbers 10 is identical, having the same cores, bristles, and corresponding diameters. In other versions, however, the plurality of scrubbers includes one or more having a larger core diameter and one or more having a smaller core diameter. Likewise, in some versions the plurality of scrubbers includes one or more having either long or small bristle diameters that differs from the others, different cores, different weights, or other variations between scrubbers.

In some versions of the method of cleaning, a single scrubber 10 may be used. In a preferred version, however, two, three, four, or five scrubbers are used to clean a bottle.

By vigorous shaking of the bottle, the scrubbers are compelled to impact the inner surface of the bottle repeatedly and with some force. In less than a minute, typically, the interior of the bottle is thoroughly scrubbed, and can then be rinsed clean. The actual time required to completely clean the bottle will depend on various factors, including, for example, the energy with which the bottle is shaken, the length and stiffness of the bristles and the size and mass of the core of the scrubber (as explained in more detail below), and the toughness of any deposits of material to be removed from inside the bottle. The limited amount of water allows the balls to impact and brush the interior surfaces with considerable velocity compared to filling the container more fully. The ball bristles also create a whisking action during shaking which foams the liquid detergent very effectively and efficiently. Thus only a limited amount of water (for example, less than twenty percent of the volume of the bottle) and detergent is necessary to clean the container, saving both. This creates environmental benefits in addition to the cleaning benefits. After shaking, the lid or cover of the container is removed, the balls are poured out into the hand, sink, or other basin, and the container is rinsed clean.

As noted above, most preferably a plurality of scrubbers is used to clean a container. Accordingly, in a version of the invention a plurality of scrubbers is provided as a set. In one such version, the plurality (preferably of two, three, four, or five scrubbers) contains scrubbers that are all the same size and configuration. In alternate version, the plurality in the set contains scrubbers of at least two different types, in which the scrubbers differ in diameter of the core, length of the bristles, or other configurations.

According to an embodiment, the outer surface of the core of the scrubber is formed of a material that is resistant to repeated exposure to most common dish-washing cleaners and household cleaning agents. For example, depending upon the specific application, any of a number of plastic formulations are appropriate, as are many metal alloys, glass, etc.

Additionally, the core has a mass selected to develop sufficient inertia during the shaking process to produce effective scrubbing action. According to an embodiment, the core has a mass of at least 2 g. According to another embodiment, the combined mass of the core and bristles is at least 2 g. According to a further embodiment, the combined mass of the core and bristles is at least 3 g.

According to an embodiment, the core is unitary, i.e., made from a single piece of material, the material being selected to provide the desired mass as well as the resistance to cleaning agents and the resilience to tolerate repeated impacts with the interior of a vessel being scrubbed. According to another embodiment, the core is made from two or more different materials. For example, according to an embodiment, the core comprises a small steel ball encased in a tough plastic, such as, e.g., nylon or acetyl (polyoxymethylene).

The stiffness of the bristles is a function of the tensile strength of the bristle material and the diameter of the bristle. Selection of the stiffness is based on several factors. For example, it is preferable that the bristles flex at least to a degree as the scrubber impacts the surface of the bottle, in order to bring more surface area of the bristle into contact with the bottle surface. If the bristles are too stiff, only the ends will contact the bottle surface, so that the total surface area affected is equal to the small points of contact of the bristles that made contact. This will tend to extend the shaking time required to adequately clean the surface. On the other hand, if the bristle flexes excessively, less kinetic energy will be transferred per unit of surface area to the bottle surface, which is less effective at removing foreign material from the surface.

For a given value of stiffness, a longer bristle will flex more than a shorter, bristle. Thus, it may be preferable to increase bristle stiffness if the lengths are to be longer. Additionally, bristle density, i.e., the number of bristles per unit of surface area, also affects the degree to which individual bristles flex upon impact with the bottle surface. A higher bristle density can increase the total surface area of contact, assuming the same degree of flex in each bristle. However, with a higher density, the kinetic energy is distributed over more bristles, which will tend to reduce the degree of flexing. Thus, as density increases, bristle stiffness should preferably decrease. Stated another way, bristle density should preferably be selected to correspond to the anticipated bristle stiffness.

Bristle density will influence the effectiveness of the scrubber at cleaning within small cavities and spaces inside the bottle. As noted, higher bristle density results in distribution of kinetic energy over many bristles, which reduces their tendency to flex upon impact. Many sports bottles include small, intricate details. Excessive bristle density will tend to result in bridging over such details, rather than penetrating into tight spaces. Proper selection of bristle density of the scrubber will enable the bristles that strike near the details to flex upon impact so that other bristles can extend into the innermost portions of the details, thereby enabling effective scrubbing.

Finally, the diameter and mass of the core also affects the scrubbing operation. If the diameter is too great, the scrubber will be unable to reach into corners or smaller parts of the bottle. For example, in some cases, some portions of a bottle would present difficulties to a scrubber with a core with a minimum dimension of more than about 1 cm. On the other hand, a larger overall size of the scrubber has a larger foot print, and thus cleans a larger area of the bottle surface at each impact. Thus, according to an embodiment, the core has a minimum dimension D1 of no more than about 1 cm, and bristles forming a diameter D3 of at least 1 cm in length, so that a minimum overall diameter D3 of the scrubber is about 2.5 to 3.5 cm.

According to an embodiment, a plurality of scrubbers of different sizes are used to clean a bottle. This enables effective cleaning of a wide range of bottle shapes and details without necessitating a special selection for specific cases. Similarly, according to an embodiment, scrubbers having a variety of characteristics are provided for use together. For example, the scrubbers can vary, not only in size, but in bristle length, stiffness, and density, and in dimensions and mass of the various cores.

Figure 3:
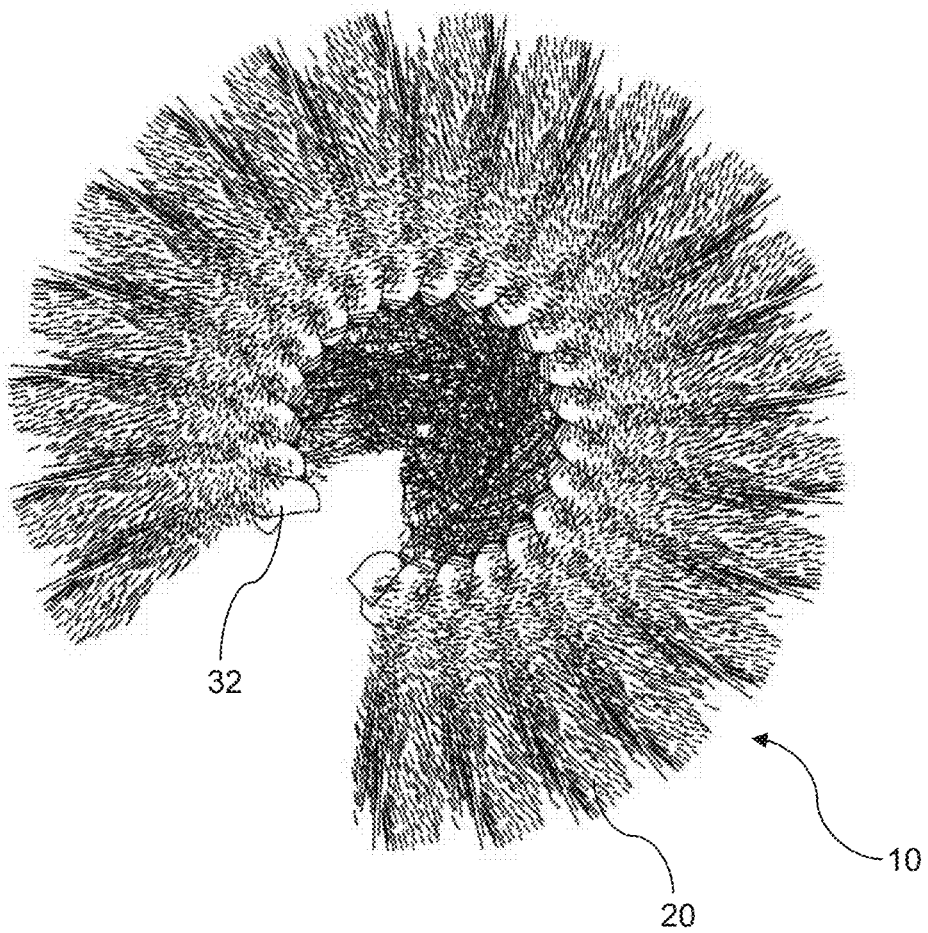
FIG. 3 is a partial cutaway view of an alternate preferred scrubber.

Turning again to FIG. 3, a scrubber 10 is shown according to another embodiment. The scrubber of FIG. 3 is made using a process that is similar to the process by which the brush shown in FIG. 8 is made, i.e., the bristles 20 are captured between twisted wires 32. This is a common method for making brushes of all kinds, and is widely employed because of its reliability and relatively low cost. According to one embodiment, a method of manufacture includes making a brush in which the twisted wires are cut very close to each end of the brush. The twisted wires are then bent into an arcuate shape so that no portion of the twisted wire extends beyond the outer shape defined by the bristles. In the embodiment shown, the ends of the twisted wire are separated by a small space. According to various embodiments, the ends are separated by different distances, and in some cases, overlap.

According to an embodiment, a manufacturing process is provided, in which a continuous brush is made, the length of which is selected according to manufacturing or handling constraints. The brush is then cut into segments having lengths appropriate to be made into individual scrubbers.

In the scrubber of FIG. 3, the twisted wires serve as the core, and, according to an embodiment, the material and diameter of the wire is selected according to desired characteristics of the core. In operation, the scrubber is used substantially as described above with reference to FIG. 2.

Figure 4:
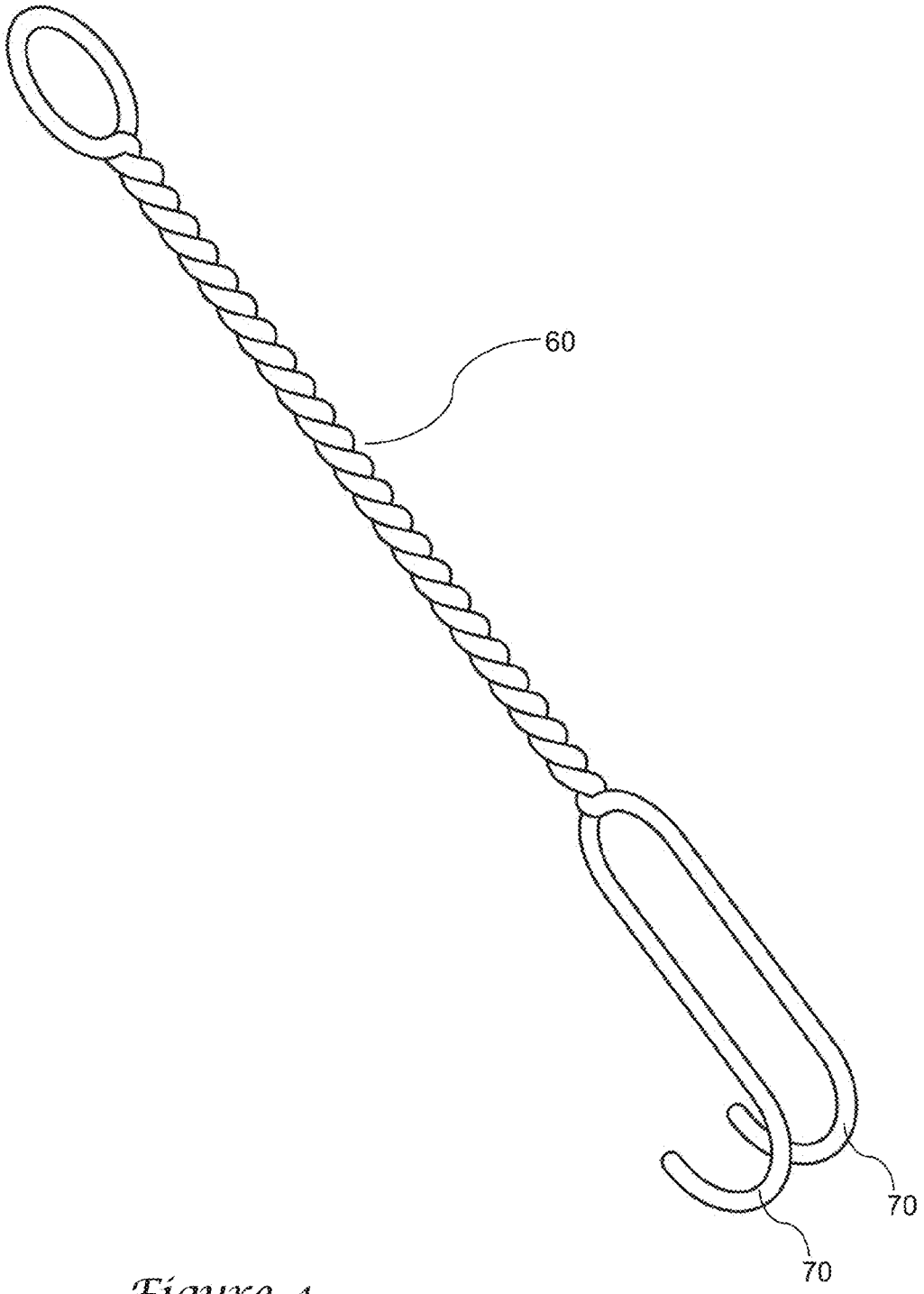
FIG. 4 is a top perspective view of a preferred hook for retrieving one or more scrubbers from inside a bottle.

FIG. 4 shows a grabbing device configured to be introduced into the mouth of a bottle, and to engage scrubbers, in order to enable their removal from the bottle. The preferred grabbing device includes an elongated handle 60 terminating in a pair of hooks 70. A user simply introduces the hook-end of the device into the bottle, and it easily captures the scrubbers so that they can be pulled from the bottle. The embodiment shown in FIG. 4 is made by twisting a wire to produce a loop at one end and a pair of hooks at the other, and can be manufactured using processes and equipment that are in common use for making brushes such as that shown in FIG. 3. In most preferred cases, the grabbing device is not required, but it is useful in instances in which the largest diameter of bristles D3 is greater than the diameter D4 of the mouth of the bottle.

As previously noted, it is preferable that a plurality of scrubbers be used to clean a bottle. According to an embodiment, the gap between the ends of the cores of the scrubbers of FIG. 3 is selected to be approximately equal to the diameter of the shaft of the grabbing device of FIG. 4. When not in use, the scrubbers can be snapped onto the shaft, which serves to keep them together for storage. According to another example, scrubbers having plastic cores are provided, the plastic cores having a notch formed therein, configured to receive the shaft of the grabbing device, substantially as described with reference to the scrubber of FIG. 3.

Figure 5:
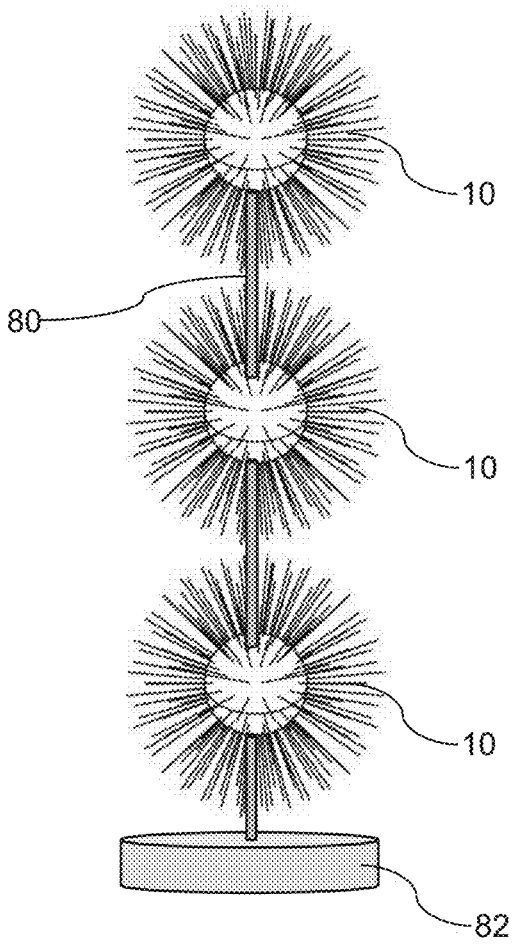
FIG. 5 is a front plan view of several preferred scrubbers mounted on a preferred scrubber stand.

As an alternative manner of storing the scrubbers when not in use, a stand may be provided. As illustrated in FIG. 5, a stand may include a base or pedestal 82 having a vertical post 80 attached to and supported by the base. In some versions, the base may be a weighted disk of sufficient weight to support the post and several scrubbers in an upright position. In other versions, the base may be a magnet that can be attached to a metal surface, or may alternatively be formed as a suction cup that may adhere to a countertop or a portion of a sink. The post 80 is preferably formed from a plastic material and may, for example, be a relatively thin extruded plastic. In some examples the post is rigid, but it may optionally be somewhat flexible. The scrubbers 10 in such a version include a hole 32 (see FIG. 1) formed diametrically through the scrubbers so that the post 80 may be inserted into and all the way through the hole. Thus as illustrated in FIG. 5, any number of scrubbers can be carried on the stand by inserting the post through the holes. In the illustrated example, three exemplary scrubbers are supported by the illustrated stand.

While embodiments are disclosed for use in scrubbing sports bottles, and the like, it will be recognized that scrubbers can be provided that are configured to aid in scrubbing a large variety of small enclosures, including, for example, lab fixtures and vessels, infant feeding bottles, reusable milk bottles, vehicle fluid reservoirs, etc. All such uses fall within the scope of the invention.

The scrubbers of the embodiments disclosed above are useful in cleaning vessels whose mouths are too small for a user to reach inside. Furthermore, because of the very large number of vessels available for use by consumers that are sized to be carried in a user's hand, there is a particular need for scrubbers that are small enough to fit into such vessels. Thus, according to an embodiment, a scrubber is provided having a minimum diameter of less than about 8 cm. According to another embodiment, the core of the scrubber has a minimum diameter of less than about 4 cm, and according to a further embodiment, a scrubber is provided whose core has a minimum diameter that is less than about 2 cm.

According to an embodiment, the scrubber has a push-through dimension of no more than about 3.5 cm. According to another embodiment, the scrubber has a push-through dimension of no more than about 2 cm. The term push-through dimension refers to the smallest diameter opening through which a scrubber can be pushed without undue effort and without causing damage to the scrubbing layer. In the case of a scrubber with bristles, factors that determine the push-through dimension include, for example, the shape and minimum dimension of the core, and the stiffness, length, and density of the bristles.

Another particular benefit of various embodiments is for cleaning vessels that have, on their interior surfaces, small details, depressions, shapes, etc., that are difficult to fully clean using a conventional long-handled brush. Accordingly, an embodiment is provided in which the core has a minimum diameter of less than about 1 cm. According to an embodiment, bristles defining the outer surface of the scrubber have a length of at least 0.8 cm. According to another embodiment, bristles defining the outer surface of the scrubber have a length of at least 1 cm. According to a further embodiment, bristles defining the outer surface of the scrubber have a length of at least 1.5 cm. According to an embodiment, the scrubber has a minimum diameter that is at least three times the minimum diameter of the core. According to another embodiment, the minimum diameter of the core is less than half the minimum diameter of the scrubber.

While the embodiments of scrubbers disclosed and described above are provided with bristles, other embodiments include other scrubbing materials. For example, various sponge-like and fibrous materials can be employed. In such cases, characteristics that are analogous to the bristle characteristics discussed above will influence their effectiveness at cleaning or scrubbing the inner surface of a vessel. For example, the stiffness and porosity of a sponge material will affect its ability to apply sufficient force per unit of surface area to properly clean the surface of the bottle. Likewise, the stiffness and thickness of the material will be determinative of its ability to penetrate into small spaces. The size and mass of the core will also influence these factors.

In embodiments that include a sponge or fibrous material, it is preferable that the core have sufficient mass to generate the necessary inertia for proper cleaning. It is also preferable that the thickness of the material be at least equal to a minimum dimension of the core, and that the core be sufficiently enclosed that no portion of the core extends beyond the outer surface of the scrubber.

The term scrubbing layer is used generically to refer to an outer layer of material that surrounds the core of a scrubber. The scrubbing layer of a scrubber can comprise, for example, natural or synthetic bristles, sponge or sponge-like material, fibrous material, matted material, felt, etc.

It will be recognized that in most embodiments, the material of the scrubbing layer of a scrubber is, to some degree, flexible. Thus, during operation, the thickness of the scrubbing layer will vary, and may, for example, become momentarily quite thin at one point and thicker at another, as the scrubber impacts a surface. Therefore, unless otherwise specified, dimensions recited in the specification or claims are to be understood as referring to values extant while the scrubber is at rest and in the absence of external forces or pressure applied to the scrubber.

As previously noted with reference to the scrubbers of FIGS. 1 and 3, the outer surface of a scrubber corresponds to a convex hull defined by the ends of the bristles. Of course, in embodiments in which the scrubbing layer is of a material other than bristles, the term can be defined by analogy to correspond to a convex hull defined by the outermost features or points of the scrubbing layer. It will be recognized that, as applied to a scrubbing layer, the outer surface is not necessarily a physical surface, particularly in the case of a scrubbing layer comprising bristles.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method for cleaning a container having a mouth forming a mouth diameter, and a container interior, the method comprising:

obtaining a plurality of scrubbers, each of the scrubbers having a core defining a maximum core diameter and a plurality of bristles attached to each one of the plurality of scrubbers, each one of the plurality of bristles extending radially outward to a bristle end and defining a bristle diameter between farthest bristle ends for each one of the plurality of scrubbers, the core diameter being smaller than the mouth diameter;

inserting the plurality of scrubbers through the mouth and into the container;

enclosing the mouth of the container; and shaking the container to cause the bristles of each of the plurality of scrubbers to contact the container interior;

whereby, shaking the container causes the scrubbers to clean the container.

2. The method of claim 1, wherein the scrubber cores are spherical, and further wherein the bristles are attached to the scrubber cores, and extend outwardly from an outer surface of the scrubber cores.

3. The method of claim 2, wherein the bristles are all the same length.

4. The method of claim 2, wherein the bristles further comprise bristles of different lengths.

5. The method of claim 2, wherein the bristle diameter is less than 5 cm.

6. The method of claim 2, wherein the bristle diameter is less than 3.3 cm.

7. The method of claim 2, further comprising obtaining a stand having a base and a post, and supporting the plurality of scrubbers on the stand.

8. The method of claim 2, wherein at least one of the plurality of scrubbers is smaller than at least one other of the plurality of scrubbers.

9. The method of claim 2, further comprising obtaining a retrieving device having a hook, and retrieving the plurality of scrubbers from the container.

* * * * *